United States Patent [19]

Patterson

[11] 4,354,419

[45] Oct. 19, 1982

[54] SURVIVABLE TARGET ACQUISITION AND DESIGNATION SYSTEM

[75] Inventor: Charles F. Patterson, Xenia, Ohio

[73] Assignee: The United States of America as represented by the Secretary of the Air Force, Washington, D.C.

[21] Appl. No.: 176,437

[22] Filed: Aug. 8, 1980

[51] Int. Cl.[3] ..... F41G 7/00; F41G 7/30

[52] U.S. Cl. ..... 89/1 A; 244/3; 244/3.1; 273/360

[58] Field of Search ..... 244/3, 3.1, 3.11, 3.12, 244/16, 153–155; 114/243, 253, 254; 273/360, 361; 89/1 A

[56] References Cited

U.S. PATENT DOCUMENTS

| | | | |
|---|---|---|---|
| 1,909,760 | 5/1933 | Gray | 273/360 |
| 2,399,215 | 4/1946 | Fahrney | 244/3 |
| 2,435,956 | 2/1948 | Craig | 114/243 |
| 2,634,924 | 4/1953 | Brown | 89/1 A |
| 2,879,999 | 3/1959 | Marshall | 273/360 |
| 3,516,624 | 6/1970 | Crook | 244/3 |
| 3,613,027 | 10/1971 | Kennedy | 114/235 F |
| 4,251,040 | 2/1981 | Loyd | 244/154 |

FOREIGN PATENT DOCUMENTS

| | | | |
|---|---|---|---|
| 2391908 | 1/1979 | France | 244/3.12 |

OTHER PUBLICATIONS

Boeing Co. Inv. Discl. A74–70, L. B. Green et al., Low Drag Streamlined Towing Cable, 4/11/74.

*Primary Examiner*—Charles T. Jordan

*Attorney, Agent, or Firm*—Donald J. Singer; Thomas L. Kundert

[57] ABSTRACT

A target acquisition and designation system is disclosed which enables an aircraft to perform aerial reconnaissance and surveillance, strikes of fixed or mobile targets, and other defense missions while at an altitude below which detection by enemy radar is effective. The system utilizes a very small, stealthy, unmanned glider equipped with a Forward Looking Infrared (FLIR) image sensor and a laser designator. The glider is towed by the aircraft and remotely controlled to fly at an elevation high above the aircraft where the FLIR and laser designator can be effectively utilized. A lightweight towline comprising one or more load-bearing tension members surrounded by a flexible member having a symmetrical streamlined exterior shape substantially reduces drag and allows the glider to be deployed from conventional aircraft.

10 Claims, 9 Drawing Figures

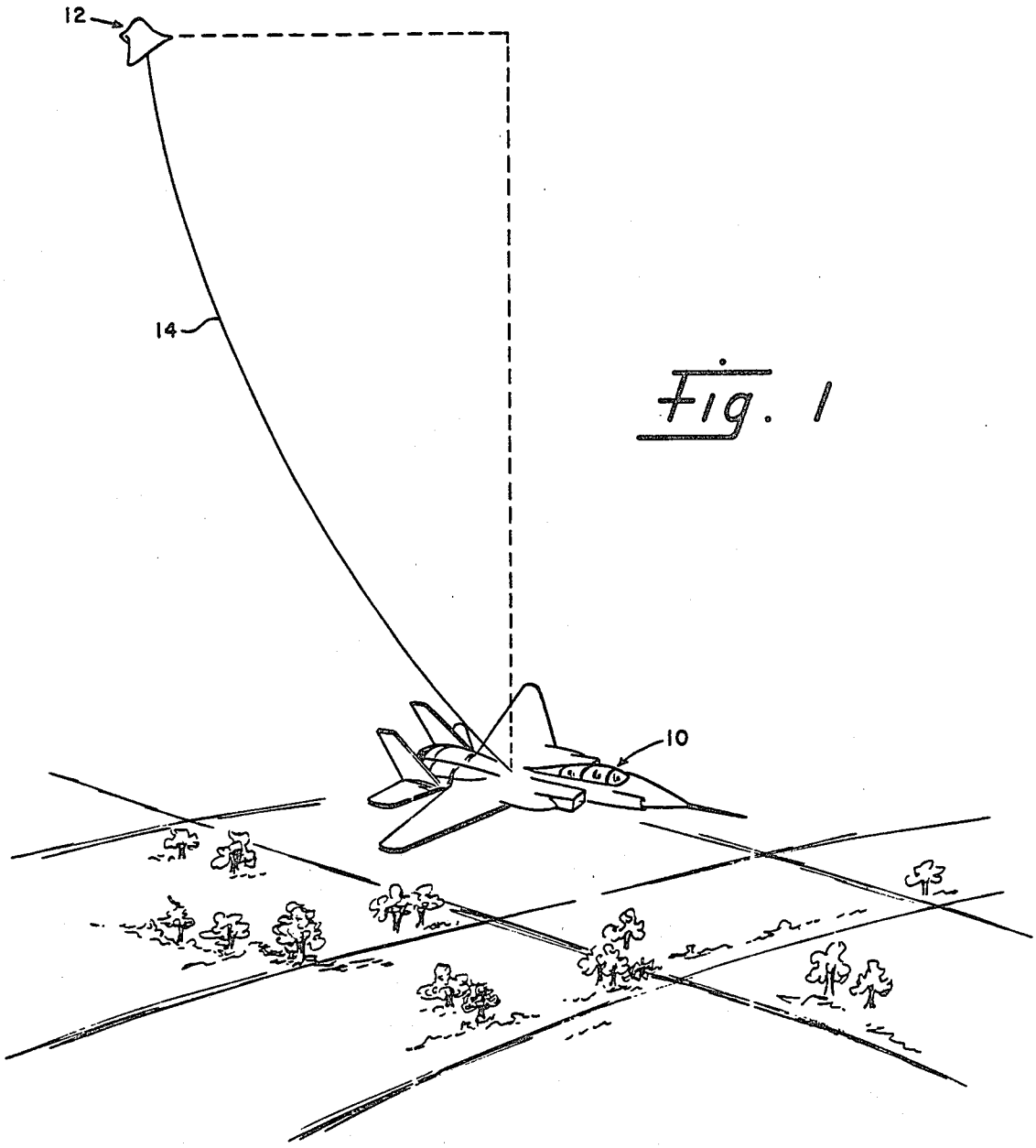
Fig. 1
Fig. 9
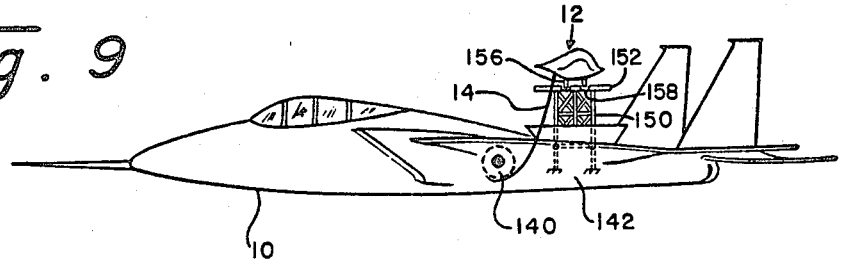

SURVIVABLE TARGET ACQUISITION AND DESIGNATION SYSTEM

RIGHTS OF THE GOVERNMENT

The invention described herein may be manufactured and used by or for the Government of the United States for all governmental purposes without the payment of any royalty.

BACKGROUND OF THE INVENTION

The present invention relates to aircraft and particularly to a target acquisition and designation system for aircraft utilizing a towed glider.

U.S. Pat. No. 1,909,760 to Gray,; Rasor, U.S. Pat. No. 2,388,013; Fahrney, U.S. Pat. No. 2,399,215; Madden, Jr., U.S. Pat. No. 3,058,692; Griffiths et al, U.S. Pat. No. 3,708,138, disclose various prior art towed gliders and targets, towing mechanisms, and low drag towlines.

The survivability of aircraft and crew in modern warfare depends a great deal on avoiding detection by radar controlled enemy guns and missiles. It is known in the art to prevent radar detection by means of electronic jamming of enemy radar signals. However, electronic jamming equipment is very costly and is itself susceptible to countermeasures. Another means of offsetting radar detection known in the prior art is to fly the aircraft at a very low altitude where interference from ground terrain renders detection by most radars ineffective. Low altitude flying has certain drawbacks, notably increased susceptibility to crashes and exposure to hostile ground fire. Nevertheless, it represents one of the most viable and successful countermeasures available.

While an aircraft may effectively avoid radar detection by flying at low altitude, it is unfortunate that the aircraft must, at some point, increase its altitude in order to perform missions such as aerial reconnaissance or surveillance and strikes of mobile targets. Avionics equipment used in the performance of these missions must operate at a substantially higher altitude than that required for radar avoidance. At such altitude, the aircraft is highly subject to enemy radar detection and immediate attack.

With the foregoing in mind, it is an object of the present invention to provide a target acquisition and designation system for use with an aircraft which will enable the aircraft to maintain a low altitude and thereby avoid enemy radar detection and still perform mission objectives, such as reconnaissance and strike.

It is another object of the present invention to provide an unmanned, remotely controlled glider having avionics equipment for performing target acquisition and designation.

It is yet another object of the present invention to provide an unmanned, remotely controlled glider, which flies at an elevation substantially above an aircraft, and performs target acquisition and designation functions for the aircraft while the aircraft remains at a low altitude.

It is another object of the present invention to provide an improved towline of reduced drag for towing a small, unmanned, remotely controlled glider at an elevation substantially above an aircraft.

SUMMARY OF THE INVENTION

A target acquisition and designation system is disclosed which enables an aircraft to perform aerial reconnaissance and surveillance, strikes of mobile targets, and other defense missions while at an altitude below which detection by enemy radar is effective. The system which is adaptable to many existing military aircraft, utilizes a small unmanned towed glider.

The glider is equipped with a Forward Looking Infrared (FLIR) image sensor or television camera and a laser designator. The equipment may be remotely controlled from the aircraft or operated, for example, by means of a preprogrammed microcomputer on-board the glider to perform target acquisition and designation. Video signals from the FLIR are transmitted to the aircraft for display to the pilot and/or recorded on video tape or other storage means. The laser designator is used in conjunction with the aircraft's weapons delivery system for directing laser controlled missiles to a target.

The glider has a very high lift-to-weight ratio and is remotely controlled by the aircraft to fly at an elevation substantially above the aircraft. Control is provided by a servomotor driven pitch control system on the glider. A bolt to which a towline is attached is moved by the servomotor forwards or backwards along the longitudinal axis of the glider. This shifts the point of attachment of the towline to the glider causing the pitch angle to change.

A towline of special design and lightweight construction is used to tow the glider. The towline comprises one or more parallel prestressed load-bearing tension members extending between the aircraft and glider. The tension members are surrounded by a flexible member comprising of two complementary airfoil sections forming a symmetrical streamlined exterior shape which acts to greatly reduce the drag of the towline in comparison to conventional towlines of circular cross section. Ballast may be inserted in the flexible member to further improve directional stability. The reduced drag, directional stability, and lightweight of the towline permit its use with conventional aircraft and in addition allows the glider to be of much smaller size than would otherwise be required to fly at the height above the aircraft necessary for the FLIR and laser designator to operate.

Transmission of signals between the aircraft and glider for operation of the FLIR and laser designator as well as the servomotor attitude control mechanism are made over a communications link preferably comprising a fiber optic cable. Space may be provided in the towline to house the fiber optic cable.

The aircraft from which the unmanned glider is deployed may be modified to include means for launching and retrieving the glider. A launch platform extending from the fuselage of the aircraft has a pad on which the glider lands and is releasably secured. A take-up reel preferably located inside the fuselage is used to wind the towline.

Additional features and advantages of the invention will be apparent from the following description and claims and are illustrated in the accompanying drawings, which show illustrative embodiments of the present invention.

BRIEF DESCRIPTION OF THE DRAWINGS

FIG. 1 is a three-dimensional view of the unmanned towed glider fully deployed from an aircraft in accordance with the target acquisition and designation system of the present invention;

FIG. 9 is an enlarged side view of the aircraft used in the target acquisition and designation system of FIG. 1 showing in greater detail the towline reel mechanism and launch platform for the unmanned glider.

DETAILED DESCRIPTION

Figure 3:
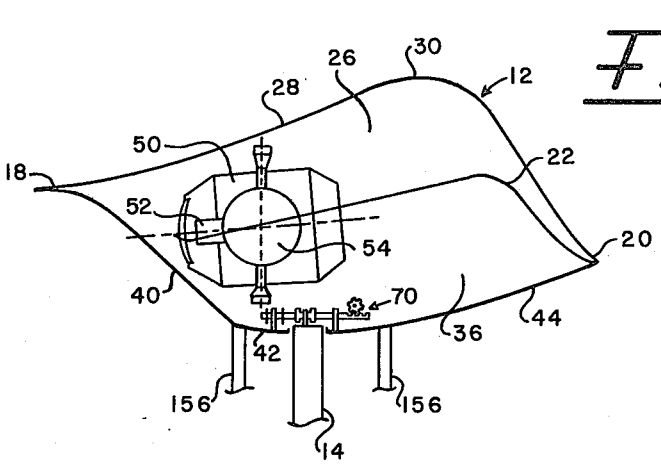
FIG. 3 is a side view of the glider shown in FIG. 2.

Turning now to FIG. 1 of the drawings, there is depicted the remote target acquisition and designation system according to the present invention. The invention is contemplated for use with an aircraft shown at 10 which preferably comprises a military aircraft of the type used for defense suppression, close aerial support, tactical strike of mobile or fixed targets, tactical reconnaissance, surveillance, forward air control, and other related missions. It is further contemplated that aircraft 10, during the performance of its mission, will fly at a low altitude of nominally 200 feet to avoid enemy radar detection. The aircraft will also fly at high subsonic or transonic speed to avoid hostile ground fire or pursuit aircraft. Aircraft 10 is provided with a deployable unmanned glider 12 which is connected to the aircraft by a towline 14. Glider 12 is designed with a high lift-to-weight ratio and has adjustable pitch control means as will be discussed in detail later so that when towed by aircraft 10 it can be flown at an elevation of approximately 600 to 4000 feet, depending on the length of towline 14. In operation, glider 12 will carry remotely controlled avionics equipment which will enable aircraft 10 to carry out target acquisition and designation functions at a lower altitude than would otherwise be possible. Because of its small size and particular shape, glider 12 has a very low radar signature and is therefore relatively undetectable. If, however, it is detected and attacked, aircraft 10 and its crew are likely to survive. With the invention, it is possible to achieve an acceptable level of target acquisition while at the same time assure an adequate degree of survivability for the aircraft and crew. Hence, the invention has been given the name survivable target acquisition and designation system, and is known by the acronym (SUTADS).

Figure 4:
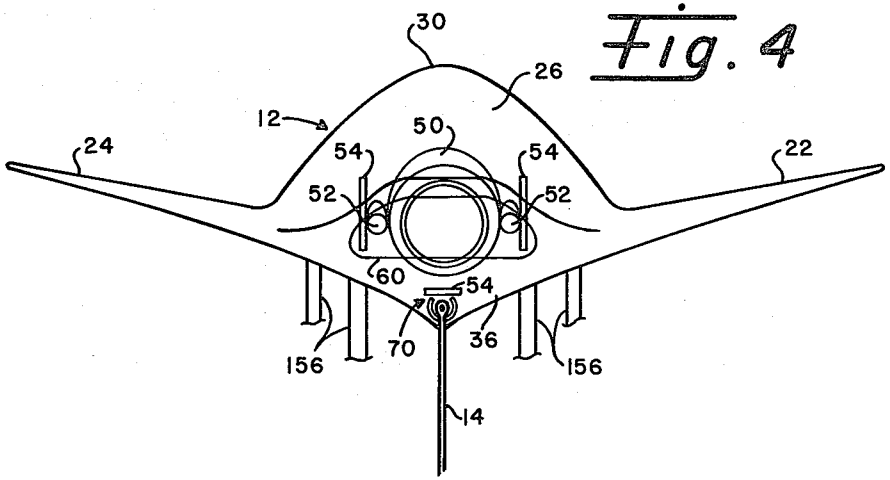
FIG. 4 is a front view of the glider shown in FIG. 2.
Figure 2:
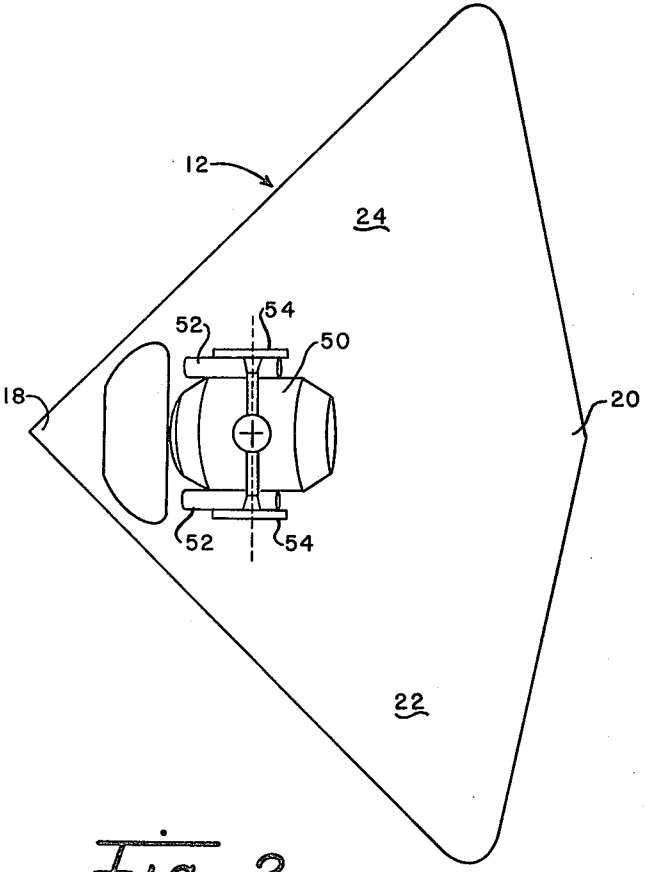
FIG. 2 is a top view of a stealthy, unmanned glider used in the target acquisition and designation system of FIG. 1.

Glider 12 is shown in greater detail in FIGS. 2, 3 and 4. The glider has a nose indicated at 18, a tail generally indicated at 20, and port and starboard delta shaped wings 22 and 24, respectively. The wings are preferably designed with a leading edge sweep of 45° and have a dihedral of 15°. A fuselage 26 has an upper portion 28 projecting upwardly and rearwardly from nose 18 to a dome indicated at 30, after which the fuselage curves sharply down to a tail 20. The lower portion of fuselage 26, indicated at 36, includes a downwardly sloping front section 40, a substantially flat bottom portion 42 and an upwardly curved aft section 44 which intersects upper portion 28 at tail 20. Glider 12 is preferably constructed of graphite epoxy material on a frame (not shown) of conventional design. Other materials such as boron epoxy or aluminum may also be used. Ideally, titanium will be incorporated in the top center section of fuselage 26 to act as a heat exchanger for avionics equipment housed in the interior of the fuselage.

Figure 6:
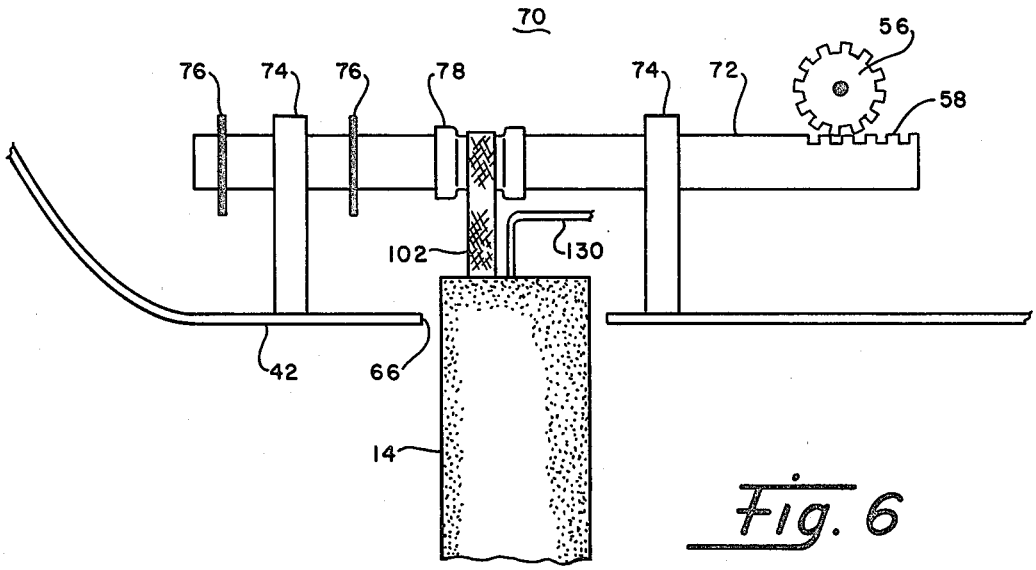
FIG. 6 is an enlarged side view of the servomotor driven pitch control system and cable attachment used in the glider.

Glider 12 is designed to accommodate a Forward Looking Infrared (FLIR) imaging sensor 50 and a carbon dioxide laser designator 52 operated at 8–12 microns and 10.6 microns, respectively. FLIR 50 and laser designator 52 are mounted on a stabilized platform 54 which is secured to the frame of glider 12 by suitable means (not shown). The FLIR and laser designator are capable of pointing atelevation angles of 0° (straight ahead) to −25°, and azimuth angles of −45° to +45° is straight ahead). The construction and operation of the FLIR and laser designator are well known and understood in the art and are not described in detail. As best seen in FIG. 4, front section 40 of lower fuselage 36 adjacent the FLIR and laser designator is provided with an aperture 60. Special infrared laser radiation transparent material, such as the type sold commercially under the name IRTRAN-2 or IRTRAN-4, is secured in aperture 60 to provide a high transmittance, low distortion window for the FLIR 50 and laser designator 52. Electric power for the FLIR and laser designator is supplied by a battery (not shown) also positioned within fuselage 26. It is contemplated that electric power could be provided to glider 12 from aircraft 10 via a conductor in towline 14. Other equipment contained within glider 12 include heating and cooling apparatus associated with FLIR 50 and laser designator 52. Command and control signals for remote control operation of FLIR 50 and laser designator 52 are communicated from aircraft 10 via a communications link in towline 14 described in greater detail below. Transmission of image data from the FLIR and status data from glider 12 are sent to aircraft 10 over the same communications link. Referring to FIGS. 3 and 6, the pitch angle of glider 12 is controlled from aircraft 10 by means of a servomotor driven pitch control system 70 which will be described in greater detail below. Command signals to operate control system 70 may be communicated from aircraft 10 via the aforesaid communications link in towline 14.

The particular design of glider 12, including the unique shape of the nose 18, the large wing dihedral, and leading wing edge sweep, as well as a forwardly located center of gravity, make it possible for the glider to have relative stability without the addition of a vertical stabilizer or roll control. It is within the purview of the present invention, however, that roll control may be specifically included on glider 12, for example, by means of wing-tip warping achieved through the use of a remote control electromagnetic torque actuator mechanism mounted to the glider frame and having actuator arms extending outwardly to the wing tips. Alternatively, ailerons could be employed for roll control.

It will be appreciated that the exact shape and size of glider 12 may vary to a limited extent depending upon particular payload, air speed, and lift requirements. However, to illustrate the invention, a specific example is provided of glider 12 designed for a towing speed of MACH 0.8. Its specifications include an overall width of 7.7 feet, an overall length of 5.0 feet, a total weight of 529 lbs. (including avionics equipment). Total wing reference area is 20 square feet. The glider develops a lift force of 5000 lbs. and has a drag force of 500 lbs. when towed with 1850 feet of towline 14 at an elevation of approximately 1500 feet above and 1000 feet behind the towing aircraft. In the above example, towline 14 has a chord length of 1.75 in. and a thickness of 0.31 in. It weighs 600 lbs, produces a drag of 4000 lbs, has a maximum tension of 5860 lbs, and a break strength of approximately 11,200 lbs. This may be contrasted with a conventional wire towline with no aerodynamic streamlining which could easily weigh more than 5 tons, produce a cable drag in excess of 800 thousand pounds, and require a glider planform area of at least an order of magnitude larger.

Figure 5:
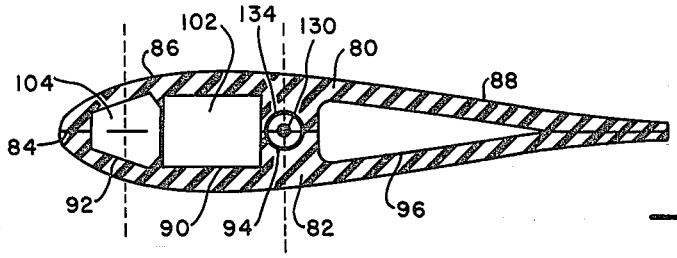
FIG. 5 is a cross-sectional view of one embodiment of a towline used in the target acquisition and designation system of FIG. 1.

The particular construction of towline 14 is shown in FIG. 5. It has two complementary airfoil sections 80 and 82 bonded together along opposing flat inner surface areas indicated by line 84. The airfoil sections 80 and 82 are preferably made of neoprene rubber and when assembled, provide a symmetrical streamlined shape having a leading edge 86 of larger cross section tapering down to a trailing edge 88 of smaller cross section. Airfoil sections 80 and 82 are formed with complementary indentations which form hollow spaces 90, 92, 94 and 96 within the interior of towline 14. A load-bearing tension member 102 which in the preferred embodiment comprises lightweight Kevlar epoxy material is adapted to fit in the space 90. It is recommended that tension member 102 be prestretched at 50% of break strength for one hour then be prestressed to 17.5% of break strength before airfoil sections 80 and 82 are formed therearound. This will reduce the amount of stretch tension member 102 undergoes under load conditions (normally 52.5% of break strength) and thereby prevent rubber airfoil sections 80 and 82 from being deformed which could result in increased drag and possibly towline failure.

Figure 8:
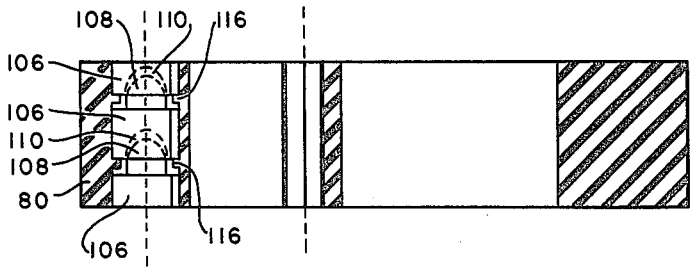
FIG. 8 is a sectioned side view of the tow cable of FIG. 5.

Ballast is positioned in space 92 for stability in order to shift the center of gravity of towline 14 forward of the center of tension. The ballast, indicated at 104, may be constructed of depleted uranium coated with tungsten or other suitable material. As shown in FIG. 8, ballast 104 consists of individual identical elements 106 having a round protrusion 108 at one end and a socket 110 at the other end. The elements are connected end-to-end with the protrusion 108 of one link inserted into socket 110 of another link. This ballast configuration allows airfoil sections 80 and 82 flexibility to expand or contract with tension member 102 as it is placed under load. Between each element 106 an annular rubber flange 116 is formed in space 92 to keep the ballast from shifting and causing towline 14 to destabilize. With the combination of individual elements 106 used as ballast, neoprene rubber used in airfoil sections 80 and 82, and Kevlar epoxy used in tension member 102, the towline is highly flexible and will expand or contract with load and, in addition, will bend as needed, as for example, when being wound on a reel.

Figure 7:
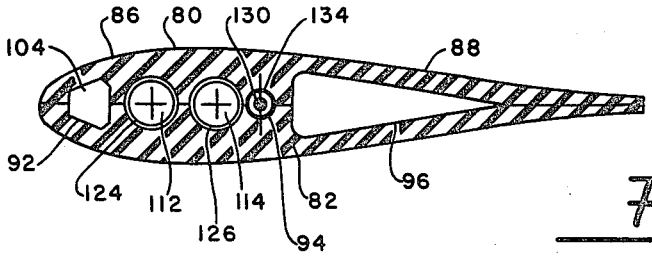
FIG. 7 is a cross-sectional view of a second embodiment of a towline used in the target acquisition and designation system of FIG. 1.

Other configurations of towline 14 may also be employed. For example, as seen in FIG. 7, a twin-tension member line is shown having two identical load-bearing tension members 112 and 114. The members may be made of round or flat Kevlar rope, MIL-C-5693 steel wire, or other suitable material. Airfoil sections 80 and 82 are modified to include spaces 124 and 126 to accommodate the two members. The ropes 112 and 114 would be prestretched and prestressed in the manner described above in the embodiment of FIG. 5, and in addition be torque balanced by being installed in opposite directions. The addition of torque balancing is especially necessary to prevent wire rope tension members from unduly twisting when stretched under load conditions.

Communication between aircraft 10 and the various electrical equipment on glider 12, including FLIR 50, laser designator 52, and servomotor driven pitch control system 70, are preferably made over a communication link comprising a fiber optic cable 130. The fiber optic cable 130 is housed in a flexible plastic tube 134 and positioned in space 94. It is provided with a slight helical shape (not shown) to allow for expansion of towline 14 under load conditions. Fiber optics is preferred because of its lightweight, small size, and capability for handling large amounts of signal data. However, it is understood that other means of electrical transmission of signals from aircraft 10 to glider 12 may be employed including, but not limited to, other forms of electric cables as well as radio transmission or laser data link. Radio transmission is not considered as advantageous as a physical wire connection in the environment of the invention because of its susceptibility to compromise and/or jamming.

Space 96 in the trailing edge of towline 14 is left vacant in the preferred embodiment to assure that the center of gravity of the towline is located forward of the center of tension. Depending on the particular design of the towline, however, space 96 may be filled with a suitable material or made solid to achieve the desired degree of directional stability.

As best seen in FIGS. 3 and 6, the aforementioned pitch control system 70 includes an elongated bolt 72 extending lengthwise along the longitudinal axis of glider 12 through spaced-apart steel or Teflon guides 74. The guides are fixedly secured by suitable means to bottom portion 42 of fuselage 26. Bolt 72 is adapted to slide back and forth through guides 74 to the extent permitted by a pair of stops 76 on the bolt. Movement of the bolt in either direction is effected by a rack 56 which engages a pinion 58 on bolt 72. Rack 56 is driven by a suitable servomotor (not shown) of conventional design. The end of towline 14 has tension member 102 exposed for attachment to glider 12 at bolt 72 midway between guides 74. The tension member passes through an aperture 66 in bottom portion 42 and is fastened around a bearing 78. The bearing is adapted to rotate around bolt 72 to allow roll movement of glider 12 of up to ±30°. Movement of bolt 72 back and forth approximately $\frac{3}{4}$ in. is sufficient to shift the attachment point of towline 14 with respect to the center of gravity of glider 12 to produce up to a 10° change in pitch angle.

Aircraft 10 is shown in greater detail in FIG. 9. Adaptation of the invention may be made to fit existing aircraft, such as the USAF F-15 Eagle air superiority fighter. A towline take-up reel 140 is fitted within fuselage 142 of the aircraft. Ideally, reel 140 will be positioned at or near the center of gravity of the aircraft to minimize disturbances in the aircraft resulting from the drag of glider 12 and towline 14. Reel 140 may comprise a single or multiple sheave drum on which towline 14 is wound side by side, leading edge down. Alternatively, towline 14 may be wound on its side. Towline 14 will be wound on reel 140 under tension nominally at $17\frac{1}{2}$% of break strength due in large part to the forces caused by contraction of the inner side of the line and expansion of the outer side while on the reel.

Tension member 102 is connected to reel 140 by removing a length of airfoil section 80, 82 adjacent the end of towline 14 and splicing the end of tension member 102 to a short length of extra strength tension material (not shown) attached to reel 140. Fiber optic cable 130 is routed from the end of towline 14 to a suitable point of attachment to the aircraft's electrical data bus. A suitable motor drive and associate mechanism (not shown) may be positioned inside reel 140 to rotate the reel for winding and unwinding towline 14.

Mounted on fuselage 142 above reel 140 is a launch platform 150 constructed of a plurality of conventional frame members fixedly interconnected by suitable fasteners. The top of platform 150 is provided with a separation/attachment pad 152 specifically designed to receive glider 12. It is preferred that glider 12 be releasably connected to pad 152 by means of locating pins 156 provided on the bottom of glider 12 which are adapted to be received in complementary apertures 158 provided on the top of separation/attachment pad 152. Platform 150 may be equipped with a cable guide (not shown) for towline 14 to assist in steering glider 12 onto pad 152 during landing. It is understood that platform 150 may be made of a collapsible design so that it could fold to a more compact form and be lowered into fuselage 142 of aircraft 10 when not in use. Other arrangements may be employed to attach glider 12 to aircraft 10. In one such arrangement, the launch platform would be eliminated and separation/attachment pad 152 is mounted directly on fuselage 142. When attached thereto, glider 12 would ride in piggy-back fashion on fuselage 142. If necessary, rather than retrieve glider 12 once it has been deployed, it will also be understood that the glider and towline may be jettisoned.

In operation, aircraft 10 will takeoff and land with glider 12 physically secured to the aircraft in a manner described above. The aircraft will travel at a low altitude of approximately 200 feet during the entire time of its mission or at least during the portion of its mission when it would be subject to enemy radar detection. Prior to carrying out the mission, aircraft 10 will initially fly at low speed (for example, MACH 0.5) during which time glider 12 will be released from engagement with pad 152 while towline 14 is unwound from reel 140. Due to its high lift-to-weight ratio design, glider 12 will climb abruptly in altitude when separated from aircraft 10. As more line is unwound and greater drag imposed on glider 12, its pitch angle may be increased through remote control servomotor system 70 causing the glider to climb further in altitude until towline 14 is completely unwound. The pitch angle of glider 12 may be frequently adjusted to obtain the desired altitude while taking care not to impose too great a load on towline 14. Once glider 12 is fully deployed, aircraft 10 is accelerated to tactical speed (for example, MACH 0.8). With glider 12 deployed at a desired elevation ranging from 600–4000 feet, FLIR 50 and laser designator 52 are placed into operation.

When towed by aircraft 10, glider 12 will follow closely the ground track of aircraft 10. This is due in large part to the symmetrical streamlined shape and directional stability of towline 14 which maintains leading edge 86 of towline 14 in line with the direction of travel. When the mission is completed, aircraft 10 reduces speed thereby reducing the tension on towline 14. Reel 140 winds in towline 14 and brings glider 12 back to pad 152.

Thus, while preferred constructional features of the present invention are embodied in the structure illustrated herein, it is to be understood that changes and variations may be made by those skilled in the art without departing from the spirit and scope of the invention. For example, aircraft 10 and glider 12 may be adapted for takeoff and landing from normal paved runways with the glider deployed. In addition, it will be apparent that numerous other variations and configurations of towline 14 may be derived from the specific embodiments disclosed.

I claim:

1. A target acquisition and designation system for use in a hostile environment, comprising: an aircraft; an unmanned glider towed by the aircraft; means controlling the glider to fly at an elevation substantially above the aircraft; a towline connecting the glider to the aircraft, said towline comprising at least one prestressed load-bearing tension member, and a flexible member surrounding the tension member having complementary airfoil sections forming a symmetrical streamlined exterior shape; electro-optical avionics means carried by the glider for acquiring and designating a target; and means for transmitting signals from the electrooptical avionics means to the aircraft.

2. The target acquisition and designation system of claim 1, wherein the load-bearing tension member comprises two parallel ropes, said ropes being prestressed and installed in opposite directions to each other.

3. The target acquisition and designation system of claims 1 or 2, wherein the flexible member has a space formed therein extending parallel to the load-bearing tension member; ballast positioned in the space, said ballast comprising a plurality of identical elements flexibly connected end-to-end.

4. The target acquisition and designation system of claim 3, wherein the means for transmitting signals from the electro-optical means to the aircraft comprises a fiber optic cable.

5. The target acquisition and designation system of claim 4, wherein the flexible member has a second space formed therein extending parallel to the load-bearing tension member, said fiber optic cable positioned in the second space.

6. The target acquisition and designation system of claim 5, further including means for directionally stabilizing the towline, said means comprising a third space formed in said flexible member extending parallel to the load-bearing tension member.

7. The target acquisition and designation system of claim 1, wherein the means controlling the glider comprises a bolt slidably mounted to the glider, one end of the load-bearing tension member being connected to the bolt; and servomotor means for moving the bolt along the longitudinal axis of the glider.

8. The target acquisition and designation system of claim 1, further including means for launching and retrieving the glider from the aircraft, said means comprising a launch platform on the aircraft; means attached to said launch platform for releasably securing the glider; and a reel for winding and unwinding said towline.

9. The target acquisition and designation system of claim 1, wherein the glider comprises a fuselage, and a pair of delta shaped wings connected to the fuselage; said fuselage having a hollow interior housing the electro-optical avionics means.

10. The target acquisition and designation system of claim 1, wherein the electro-optical avionics means comprises a forward looking infrared (FLIR) image sensor and a laser designator.

* * * * *

UNITED STATES PATENT AND TRADEMARK OFFICE

CERTIFICATE OF CORRECTION

PATENT NO. : 4,354,419

DATED : October 19, 1982

INVENTOR(S) : Charles F. Patterson

It is certified that error appears in the above—identified patent and that said Letters Patent is hereby corrected as shown below:

Col. 2, line 33, change "comprising" to --- consisting ---.

Col. 3, line 10, change "cable" to --- towline ---.

Col. 4, line 15, change "atelevation" to --- at elevation ---.

Col. 5, lines 11-12, change "800 thousand pounds" to --- 800,000 lbs. ---.

Col. 8, line 20, In the claims, change "electrooptical" to --- electro-optical ---.

Signed and Sealed this

*Twenty-ninth* Day of *March 1983*

[SEAL]

*Attest:*

GERALD J. MOSSINGHOFF

*Attesting Officer*

*Commissioner of Patents and Trademarks*